US005558013A

United States Patent [19]

Blackstone, Jr.

[11] Patent Number: 5,558,013

[45] Date of Patent: Sep. 24, 1996

[54] DEVICE AND METHOD FOR ELECTRONICALLY MEASURING THE FULLNESS OF A TRASH RECEPTACLE

[76] Inventor: James O. Blackstone, Jr., 85 Hickory La., LaGrange, Ga. 30240

[21] Appl. No.: 998,525

[22] Filed: Dec. 30, 1992

Related U.S. Application Data

[63] Continuation-in-part of Ser. No. 879,487, May 7, 1992, abandoned.

[51] Int. Cl.[6] ..... B30B 15/18

[52] U.S. Cl. ..... 100/35; 100/50; 100/99; 100/229 A

[58] Field of Search ..... 100/35, 43, 48, 100/50, 52, 99, 229 A

[56] References Cited

U.S. PATENT DOCUMENTS

| | | | |
|---|---|---|---|
| 2,764,932 | 10/1956 | Pease, III | 100/50 |
| 3,040,653 | 6/1962 | Neitzel | 100/50 |
| 3,842,729 | 10/1974 | Mandrup | 100/229 A |
| 3,893,386 | 7/1975 | Wise | 100/50 |
| 4,007,678 | 2/1977 | Gustavsson et al. | 100/229 A X |
| 4,953,109 | 8/1990 | Burgis | 100/50 X |
| 5,016,197 | 5/1991 | Neumann et al. | 100/50 X |
| 5,173,866 | 12/1992 | Neumann et al. | 100/50 X |
| 5,299,142 | 3/1994 | Brown et al. | 100/50 |

*Primary Examiner*—Stephen F. Gerrity
*Attorney, Agent, or Firm*—Jones & Askew

[57] ABSTRACT

An electronic device for monitoring the fullness of a trash receptacle is disclosed. The trash receptacle is associated with a compactor that has a compression member for compacting trash within the receptacle. The compression member is powered by an electric motor. The current drawn by the electric motor is monitored by a current sensor. As more trash is deposited and compacted, the sensor detects an increased current flow in the electric motor. A microprocessor operates on the current sensor readings to determine the relative fullness of the receptacle. The current sensor readings are evaluated by an algorithm which distinguishes the current readings due to foward compactor ram motion of the compression member from current readings due to reverse compactor ram motion. The algorithm compares modified derivatives of the current sensor readings to threshold values of the derivatives in order to determine the relative fullness of the receptacle.

9 Claims, 9 Drawing Sheets

DEVICE AND METHOD FOR ELECTRONICALLY MEASURING THE FULLNESS OF A TRASH RECEPTACLE

CROSS-REFERENCE TO RELATED APPLICATION

This is a continuation-in-part of Ser. No. 879,487, filed May 7, 1992, and now abandoned.

TECHNICAL FIELD

The present invention relates to industrial trash compactors. More particularly, the present invention relates to a device that electronically measures the fullness of a trash compactor (or a plurality of trash compactors) for each compaction cycle. These measurements may be recorded sequentially so as to provide a plot or curve, such that the compactor's fullness is monitored. When these measurements indicate that the compactor is sufficiently full, the compactor can be emptied, thus eliminating premature emptying and insuring against overfilling a compactor.

BACKGROUND OF THE INVENTION

The management of trash and refuse disposal has become increasingly important. Society presently creates a great volume of trash on a daily basis, in part due to the increased popularity of disposable products. In any event, it has become necessary to develop techniques and equipment that can process and dispose of greater and greater amounts of trash.

A principal mechanism for disposing of and processing significant volumes of trash is an industrial trash compactor. An industrial trash compactor comprises a compacting ram and a stationary receptacle (container) that, in combination one with the other, compresses trash to make efficient use of the container's total available volume. Typical receptacles include, for example, a dumpster that serves as a container for the trash. When the dumpster is full, it must be emptied. The typical dumpster often does not include a compactor. Thus, space is wasted if the trash is voluminous but capable of being downsized. As a result, the use of compactors has become commonplace. Such receptacles and compactors are often placed in high population areas such as apartments, condominiums, office buildings and the like. Users deposit their trash into the receptacle, whereupon the compactor system may compress the trash. The compactor is used periodically to compress the trash, thereby maximizing the amount of trash that can be contained in the receptacle.

Once the receptacle is full of compressed trash, it must be emptied. This involves exchanging the full receptacle with an empty receptacle by a specially-configured truck that empties the full receptacle at a suitable dumping site. It is very expensive to exchange, haul and dump the compacted trash. The exchanging, hauling and dumping processes are each expensive. Each process requires the maintenance and operation of specially-configured trucks. Such operations include not only the cost of operating the machinery, but also significant labor costs. Therefore, the exchange portion of the process is rendered even more expensive if the receptacle is not full because more exchanging, hauling and dumping is required to dispose of a given amount of trash.

However, the weight of the compacted trash can itself become a problem as many states have established weight limits for vehicles that travel the roadways. An overly full receptacle may exceed such a limit. Moreover, those skilled in the art will appreciate that a compactor and receptacle should not be overfilled such that trash is spilling onto the surrounding area. Use of a compactor that has been overfilled causes its own damage in environmental terms. In such an event, use of the, compactor is usually interrupted. Accordingly, to insure that the receptacle does not overflow, many users of receptacles and industrial compactors require the hauler to empty the receptacle frequently, even if the receptacle is not full. The hauler is paid by the trip, not in accordance with the fullness of the receptacle. This accepted method of waste disposal is therefore neither efficient nor cost effective. Ideally, the hauler would empty the receptacle only when the receptacle is full. Thus, there exists a tension in that the proper fullness of a compactor and receptacle assembly must be sufficient to warrant the cost of emptying the receptacle but not so "full" as to be overflowing the receptacle's capacity for containing compressed trash.

Others have addressed the problem of emptying trash receptacles at the optimum time and fullness. Such other methods have traditionally included the use of devices to sense and analyze fullness. One known prior art method is found in U.S. Pat. No. 3,765,147 to Ippolito, which discloses the placement of a photoelectric cell within the interior of the receptacle. The photoelectric cell senses when the receptacle is full. Use of a photocell can be inaccurate, however, because it can yield a premature indication that the receptacle is full. For example, if a large volume of highly compactable material such as foam rubber is in the receptacle, the photoelectric cell will register full despite the fact that additional material may be placed there, in. Further, should a long board or some other oddly-shaped object be put into the receptacle, it may trigger the photoelectric cell despite the fact that the receptacle may otherwise be empty. It is the nature of trash that it is neither uniform nor predictable in its composition. Thus, the potential for a false reading is an inherent limitation in the use of a photoelectric cell as a monitoring device.

U.S. Pat. No. 4,773,027 to Neumann et al. teaches another prior art method and provides an automated trash management system that monitors the fullness of various receptacles within a system. A plurality of remote status units are set up in operative association with a plurality of containers. The remote status units communicate with a central unit that monitors the fullness of each remote trash receptacle. When the central unit learns that a particular remote compacting unit is full as sensed by the remote status unit, a hauler is notified and dispatched to empty that remote compacting unit. The remote status unit of the Neumann et al. patent employs a sensing device that monitors pressure in the hydraulic system of the compactor. In other words, rather than utilizing a fixed position sensor as taught by Ippolito, Neumann et al. teaches sensing the amount of pressure in the hydraulic system that drives a piston to effect the trash compacting action to thereby determine whether the receptacle is full. As more trash is placed into the compactor, more pressure will be registered by the hydraulic system as it attempts to compress greater volumes of trash. In theory, if the receptacle is not full, something less than a predetermined maximum amount of pressure will be detected in the hydraulic system. Once filled to the desired level, a predetermined maximum amount of pressure is reached and sensed. At this time, the hauler is dispatched to empty the receptacle.

This prior art method of monitoring the fullness of a receptacle is also limited. Such a method depends entirely upon pressure within the hydraulic system to determine when the trash receptacle is full. If something other than a hydraulic compaction system is employed, the monitoring function is lost. Moreover, installation of such a system is necessarily time consuming and difficult. At least one hydraulic line must be removed and the sensor placed within the hydraulic system.

U.S. Pat. No. 5,016,197 to Neumann et al. (Neumann et al. '197) also determines fullness by monitoring hydraulic pressure. The Neumann '197 system constantly monitors the hydraulic pressure in the forward hydraulic lines by using a pressure extractor that finds the peak of a gradually increasing pressure function. The criteria used in the algorithm to determine the peak pressure must be individually assessed as the criteria are based upon the particular compactor/container unit on which the trash management system is applied. The peak of the gradually increasing pressure feature for the compaction cycle can be determined to be the back pressure on the compression member when it is at a position of maximum compaction. The maximum compaction readings are used as an indication of fullness of the trash receptacle. Since pressure sensors are placed in forward hydraulic lines, the irregularities introduced into the complete compaction cycle due to reverse motion do not have to be compensated for in the pressure algorithm.

Another embodiment of Neumann '197 suggests to monitor, as a substitute signal for instantaneous compression member pressure, a current signal proportional to the current applied to a motor within the hydraulic power pack. The substitute current signal is evaluated through the same peak pressure circuit as the pressure sensor signal discussed above. Monitoring a current signal proportional to a current within the hydraulic power pack via the same peak pressure analysis circuit produces erroneous results in various compactors.

Unlike pressure sensors which monitor pressure in forward hydraulic lines, current monitoring devices must be equipped to accurately differentiate between current due to reverse compaction ram motion and current due to forward compaction ram motion during a complete compaction cycle, as there is no separate current source for the forward and the reverse motions. In many compactors, because the hydraulic piston's face is unobstructed in the forward direction but obstructed by rods or other impedients in the reverse direction, the hydraulic efficiency of moving the compacting ram assembly forward is higher than the efficiency of moving the same assembly in the reverse direction. The lower efficiency in the reverse direction requires a higher current output in the reverse direction than in the forward direction for empty or partially full receptacles. If the current is monitored through the peak pressure circuit as suggested by Neumann et al, '197, erroneous or inaccurate data will result because the peak substitute current (pressure) recorded for the current profile of the cycle will be the reverse peak current and not the forward peak current. Further, because the current waveform is different from the pressure waveform, it is doubtful that current may be substituted for pressure to produce accurate data as suggested by Neumann et al, '197. The resulting inaccurate data will cause incorrect fullness determinations for various compactor cycles.

A typical trash compactor is an electromechanical device that utilizes an electric motor to power a hydraulic pump. The hydraulic pump, in turn, produces a hydraulic pressure that is applied to a piston in a compactor assembly that compresses the trash contained in the receptacle. The above-described prior art methods address the mechanical portion of the device used to effect compaction. The prior art has not adequately addressed the electrical energy that is also a part of the compaction process.

Thus, there is a need in the art for a low cost, accurate, simple, easily installed device that utilizes the electrical energy of the compaction process to determine the fullness of the receptacle. Such a device would preferably be adaptable to various types of composition assemblies and not adversely affected by weather conditions or other environmental hazards. Moreover, such a device would preferably be readily incorporated into a waste disposal system whereby the fullness of the receptacle could be remotely monitored and a hauler dispatched at an appropriate time.

SUMMARY OF THE INVENTION

The present invention fulfills the need in the prior art by providing a low cost, accurate, simple, readily adaptable device for measuring the fullness of a receptacle fitted with a trash compactor. The present invention thus provides an accurate and cost-effective sensing device that utilizes the electrical energy expended to effect compaction of the trash to determine the fullness of the receptacle.

Generally described, the present invention comprises means for measuring the electrical motor current flow during operation of a compactor. In an electromechanical system such as a trash compactor, increasing the mechanical work output demand results in an increase in the electrical input demand. As the compactor is called upon to exert greater mechanical force to compact the trash (as more trash is placed into the receptacle), the electrical current flow increases. A predetermined maximum amount of current flow is established as being reflective of a full receptacle. This measurement of the current flow in the electrical system of the compactor is utilized to indicate a full receptacle. In addition, a measurement of the power being supplied to the compactor may also be taken to indicate a full receptacle. In this manner, the fullness of a trash receptacle fitted with a compactor can be monitored.

Described somewhat more particularly, the present invention is embodied in a waste disposal system comprising a plurality of trash collection receptacles with compactors. Each receptacle is provided with a compaction assembly that includes a ram for compressing trash within the receptacle. The compaction assembly is powered by an electric motor that in conjunction with the compaction assembly, serves to effect the compacting action. In the preferred embodiment, a current flow sensor is installed on one of the compactor's electrical input wires. The sensor may, for example, be secured about the electric motor power input line. The current flow sensor may be operatively associated with a remote monitoring facility whereby the flow measurement can be remotely noted. As the receptacle fills with trash, the compactor is periodically activated. As the volume of trash increases, the compactor assembly ram will encounter increased resistance, thereby resulting in an increased current flow. As the current flow during forward compaction ram motion is increased in amperes (or "amps"), a predetermined maximum amperage reading is established that is reflective of a full trash receptacle. The present invention distinguishes the current at maximum compaction (peak forward current) from the current flow due to reverse compaction ram motion that exist in various compactors. If the current flow sensor reading equals or exceeds the predetermined maximum amperage reading, a hauler can be notified and dispatched to empty the receptacle.

Thus, the force exerted on the compaction assembly by virtue of the forward compaction ram motion results in a corresponding increase in the amount of electrical input or current flow required by the electrical motor. This increased current flow represents an indication of the receptacle fullness, as the increased current flow during forward compaction ram motion is an indication of the increased force encountered by the compaction assembly. The present invention is independent of the intermediate energy conversion scheme necessary to effect compaction. The present invention is not limited merely to electrical energy measurement, but may include any electrical measurement that is adequately related to the proportional relationship between the mechanical work being done and the electrical energy used.

Measurement of electrical current offers several advantages. Current sensors can be configured such that a contact-to-contact connection to the electrical current-carrying conductor is not necessary, since one way of measuring this current is by measuring the magnetic flux caused thereby. The conductor is passed through a magnetic current sensing device, which measures the intensity of the magnetic field which is directly proportional to the flow of current through the conductor. Such sensors, which include an electrician's clamp-on ammeter, are well-known and have a relatively low cost. Such devices provide several advantages. The current sensor is easily installed by inserting the conductor through a prefabricated opening in the device. The sensor may be installed at any location along the conductor, permitting installation with an enclosure to guard the sensor from the elements. Since the sensor is magnetically coupled to the conductor, it is immunized from power line transients that would otherwise cause damage to the circuitry.

The present invention provides a trash compactor which has a trash receptacle, a compactor unit having an electric motor for compacting trash within the trash receptacle, means for measuring the current drawn by the electric motor during operation of the compactor unit, and means responsive to the current drawn for determining the amount of trash within the trash receptacle. The electric motor draws a first current when compacting the trash and a second current when repositioning after compacting the trash, and the responsive means distinguishes between the first current and the second current to determine the amount of trash.

The present invention also provides a method of monitoring the amount of trash in a trash receptacle and compactor unit by measuring the current drawn by an electric motor during operation of the compactor unit, and determining the amount of trash in the trash receptacle based on the current drawn by the electric motor. The electric motor draws a first current when compacting the trash and a second current when repositioning after compacting the trash, and the present invention distinguishes between the first current and the second current to determine the amount of trash.

Thus, it is an object of the present invention to provide a device for measuring the fullness of a trash receptacle.

It is a further object of the present invention to provide a device for measuring the fullness of a trash receptacle that measures the electrical energy utilized during the mechanical compaction of trash within the receptacle.

It is a further object of the present invention to accurately determine fullness based on the measured electrical energy during forward compaction ram motion.

It is a further object of the present invention to provide a device for measuring the fullness of a trash receptacle that avoids reliance upon sensing the pressure of the hydraulic system of a trash compactor used to effect compaction of the trash.

It is a further object of the present invention to provide a device for measuring the fullness of a trash receptacle that avoids reliance upon the strain placed upon the structural components of the compaction assembly.

It is a further object of the present invention to provide an electrical monitoring device that may be utilized to determine the fullness of a trash receptacle fitted with a compactor.

It is a further object of the present invention to provide an improved trash monitoring system that is not limited by measuring the structural strain or the hydraulic pressure that results during a compaction cycle.

It is a further object of the present invention to provide an improved trash monitoring system whereby pertinent information can be obtained from the electrical energy utilized to effect the compaction of trash.

It is a further object of the present invention to provide an easily installed, easily maintained and reliable system for measuring compactor fullness.

It is a yet further object of the present invention to provide a cost effective system for measuring compactor fullness.

These and other features of the present invention will become apparent from a reading of the following detailed description taken in conjunction with the accompanying drawings.

DETAILED DESCRIPTION OF THE PREFERRED EMBODIMENTS

Figure 1:
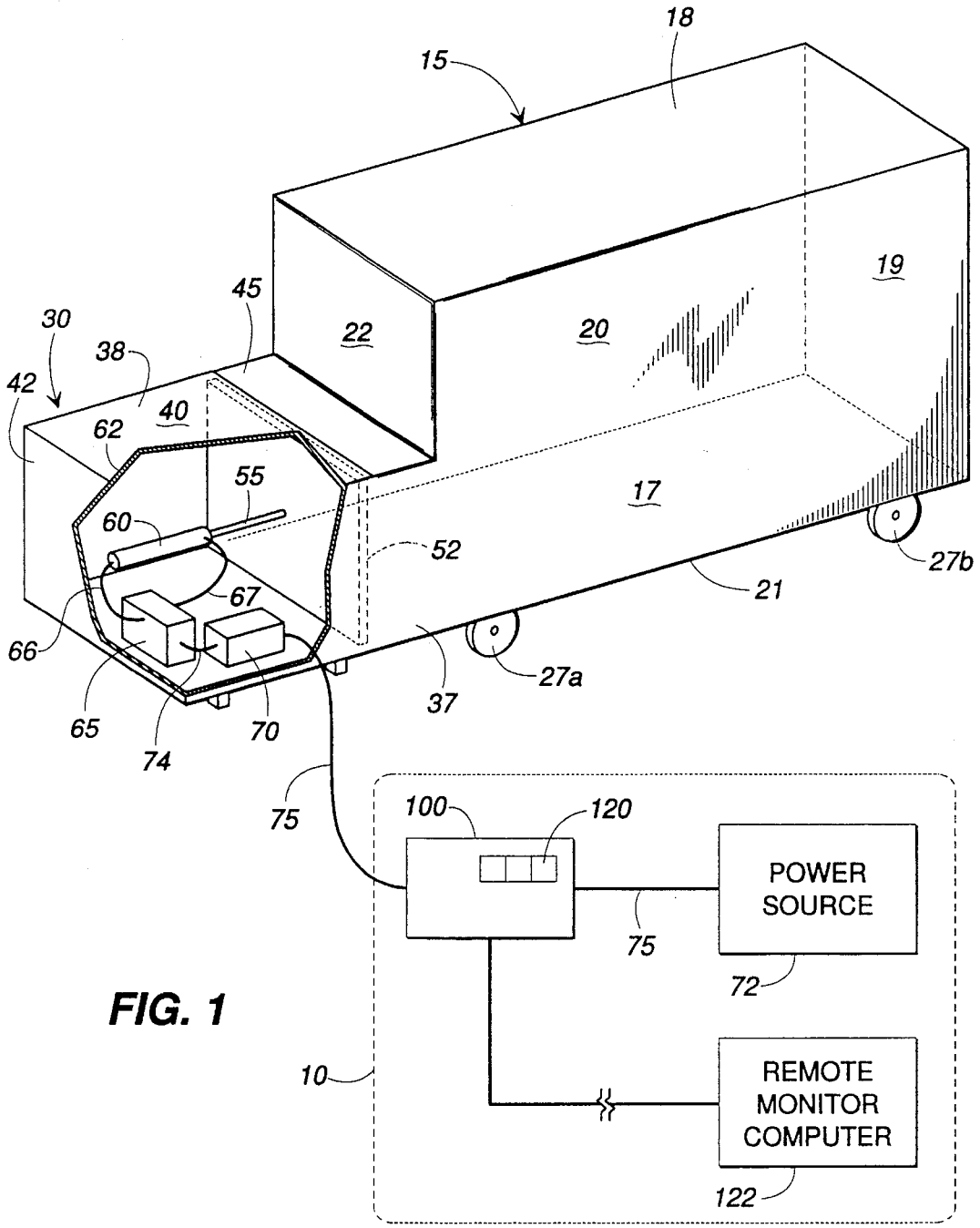
FIG. 1 is a diagrammatic, schematic illustration of a trash receptacle and compactor including a device for electronically measuring the fullness of the receptacle in accordance with the present invention.

Referring now in more detail to the drawing figures, in which like numerals indicate like parts throughout the several views, FIG. 1 shows a device 10 for electronically measuring the fullness of a trash receptacle 15 in accordance with the present invention. The trash receptacle 15 is shown as a substantially rectangular member having a floor 17, a ceiling 18, a rear wall 19, a left side wall 20, a right side wall 21 and a partial front wall 22. It is to be understood that the front wall 22 of the receptacle 15 is partial in that an opening is provided immediately below the front wall 22 so as to facilitate the compacting action as described below. The receptacle 15 includes four wheels, only two of which are shown as 27*a* and 27*b*, to permit rolling of the receptacle as necessary.

A compacting assembly 30 is provided immediately adjacent to the receptacle 15. The compacting assembly 30 is fixedly secured to the receptacle 15 in a conventional manner to permit and insure compaction therebetween. The compacting assembly 30 consists of a housing which, in turn, defines a floor 37, a ceiling 38, a left side wall 40, a right side wall 41 and a forward or front wall 42. An opening 45 is defined in the top surface or ceiling 38 of the compaction assembly 30. Trash is introduced to the receptacle 15 and the compaction assembly 30 through the opening 45. Those skilled in the art will appreciate that a chute (not shown) may be mounted within or over the opening 45 to funnel trash into the compactor assembly 30 and receptacle 15.

The compacting assembly 30 further consists of a plate 52 which is connected to one end of a rod 55. The rod 55 is connected at its other end to a hydraulic cylinder 60. The trash is compressed as described herein. The rod 55 and face plate 52 may be constructed of any material suitable for repeated engagement with the trash so as to effect compaction thereof. The hydraulic cylinder 60 is conventional in that it is powered by a hydraulic system 62 that is well known in the art. The hydraulic system 62 serves to move the ram face plate 52 toward and partially into the receptacle 15. The hydraulic cylinder 60, like the hydraulic system 62, is conventional. It is to be understood that the cylinder 60 may be powered by other means such as a pneumatic system or a mechanical linkage. Such other mechanisms for powering the cylinder 60 are expressly contemplated to be within the scope of the present invention so long as they are operated in response to an electrical stimulus. The hydraulic cylinder 60 is driven by hydraulic power pack 65, such as a pump, through hydraulic lines 66 and 67. The details of such a system are known to those of ordinary skill in the art and need not be further disclosed herein.

Power is supplied to the compactor assembly 15 by means of an electric motor 70. Power is, in turn, provided to the electric motor 70 by means of a utility power source 72, external of the compactor assembly 15, into which a conductor 75 is plugged. The conductor 75 represents any one of the 2 or 3 phase power lines of the power source 72. The electric motor 70 may be an alternating current (AC), induction motor because of its rugged construction and relatively low cost. The electric motor 70 powers the hydraulic system 62. In this manner, the hydraulic cylinder 60 can be actuated to compress trash contained within the receptacle 15. The electric motor 70 provides such power to the hydraulic system 62 by means of a mechanical connection 74. In some systems, the electric motor 70 and the hydraulic power pack 65 are constructed as a single unit.

When electrical power is applied to the motor 70, the motor powers the hydraulic system 62. The pump in the hydraulic power pack 65 of hydraulic system 62 drives the hydraulic fluid which, in turn, drives the cylinder 60. The hydraulic cylinder 60 drives the rod 55 and the ram face plate 52 forward toward and into the receptacle 15. As a result, the face plate 52 engages trash deposited into the opening 45 and resting on the compactor assembly floor 37 and the receptacle floor 17. The trash is moved by the face plate 52 toward the rear wall 19 of the receptacle 15. Once the rod 55 travels a predetermined length, or the preset maximum hydraulic limit is reached, the motor 70 reverses the hydraulic system 62 to thereby withdraw the rod 55 and face plate 52 back into the compaction assembly 30. Once the rod 55 and the face plate 52 are returned to their original positions, the compaction cycle is completed.

As the volume of trash deposited into the opening 45 increases, the travel of the rod 52 and face plate 55 will become more laborious. In other words, as more trash is introduced into the compaction assembly 30, the face plate 55 will encounter greater resistance as it compresses the trash. This resistance will cause a back pressure in the hydraulic system 62, making: it progressively more difficult for the hydraulic cylinder 6( to fully extend the rod 55 (and face plate 52). The back pressure in the hydraulic system 62 will, in turn, cause a resistance to be exerted on the electric motor 70. This resistance will be reflected in an increased current flow into the motor 70 as the motor attempts to meet the power needs of the hydraulic system 62. Thus, an increased current flow will be experienced in electrical conductor 75.

The current flow through conductor 75 is preferably monitored by a current sensor 100. The current sensor 100 may be a standard device of the type known to those of ordinary skill in the art for measuring current flow, typically in amperes or "amps." It is known that when an electric current flows through a wire, the current flow creates a magnetic field around the wire. Current sensors, such as that shown at 100, utilize the magnetic field around the wire to determine the amount of current flowing through a wire.

The current sensor 100 serves to measure the strength of the magnetic field that surrounds the conductor 75. Those skilled in the art will appreciate that it is possible to measure the current flow in conductor 75 by other means. Magnetic coupling, as shown here, affords certain advantages. A current sensor 100 is easily installed and reliable. Even with magnetic coupling, current sensors can be of varied types. For example, an early type of current sensor utilized a transformer action. A more recent example is a current sensor that uses a magnetically-sensitive ("Hall-effect") semiconductor. Both of these types are characterized by a donut-shaped magnetic core material through which the conductor is placed. In a transformer type sensor, the conductor acts as the primary electromagnetic element of a transformer, and turns of wire around the core act as a secondary electromagnetic element. The current is induced into the secondary element that is proportional to the primary element (the conductor). In the Hall-effect device, the semiconductor sensor is inserted into a narrow slit in the core. This semiconductor sensor detects the existence and strength of the magnetic field induced by the conductor, from which a proportional output voltage may be generated.

An example of such Hall-effect devices are those currently available from Microswitch, a division of Honeywell under the trade designation "CS Series."

Figure 2:
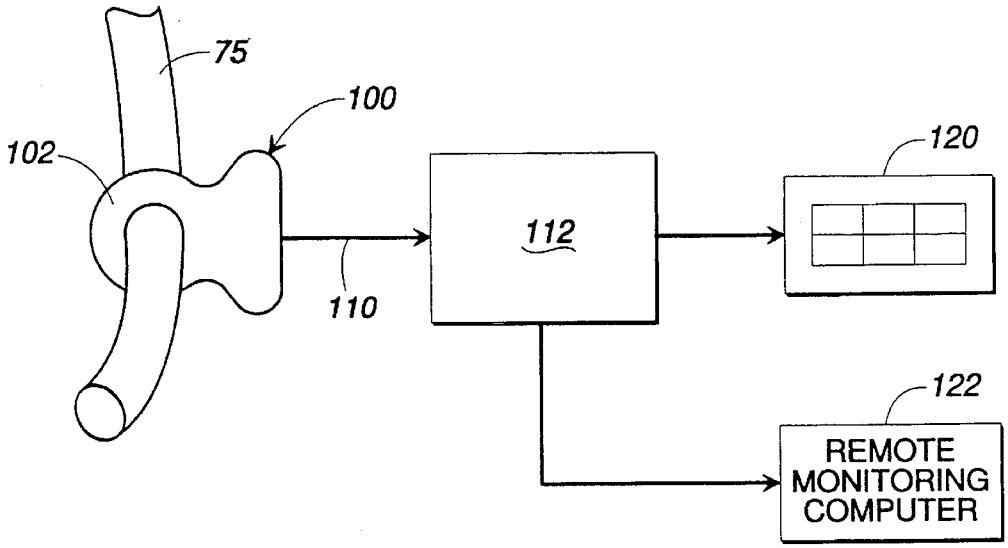
FIG. 2 is a diagrammatic, schematic view of a current flow sensor in accordance with the present invention.

Referring to FIG. 2, the current sensor 100 comprises a donut-shaped portion 102 or toroid through which conductor 75 is inserted. When current flows in conductor 75, the sensor 100 detects the existence and intensity of the resultant magnetic field. A signal (output voltage) is generated that is proportional to the current flowing in conductor 75. This signal, indicated at line 110 in the drawing, may be measured and stored in a microprocessor unit 112 in a conventional manner. The intensity of the signal may be displayed at a display monitor indicated generally at 120. The signal may be transferred to a remote monitoring computer 122, where it can be compared to a value set for indicating a full container as described in greater detail below.

Referring again to FIG. 1, during each compaction cycle, a stress force is encountered by the rod 55 and the face plate 52. This stress is due directly to the amount of trash in the receptacle 15. If the receptacle is empty, little or no stress is placed on the face plate 52 and rod 55. However, as the receptacle 15 fills, the stress coefficient rises. A corresponding increase occurs in the pressure of the hydraulic system 62 that powers the rod 55, and a corresponding increase occurs in the current drawn by the electric motor 70. The current sensor 100 measures such increased current. The increase can be monitored over time so as to effect a comparison. For example, the amps used to power the electric motor should progressively increase. Thus, by obtaining current flow information over time and comparing it, the utilization of the receptacle 15 may be monitored.

It will be appreciated that when the receptacle 15 is full of trash, the travel of the rod 55 and the face plate 52 will be restricted. At this point, the resistance encountered by the face plate 52 and rod 55 will be at a maximum, as will the pressure encountered by the hydraulic system 62, as will the current flow delivered to the motor 70. As a result, the current flow through conductor 75 is reflective of the amount of trash in the receptacle 15.

Thus, it will be appreciated from the foregoing that by monitoring the motor 70 current, an operator is able to determine the fullness of the receptacle 15. The preferred embodiment places the sensor 100 about the conductor 75 because the measurement can be taken outside of the compaction assembly where it can be easily installed. Nonetheless, it is to be understood that such a measurement device can be placed inside of the compactor assembly, and the resulting measurement of the fullness can be captured and stored by a microprocessor, and then either can be transferred by a modem and telecommunication line to a remote source whereat the fullness can be monitored, or the fullness can be displayed locally.

It is to be understood that, as the current increases in the conductor 75 which carries power to the trash compactor assembly pump motor 70, the magnetic field intensity surrounding the conductor 75 increases proportionally. During the compaction cycle, this current is an indication of the amount of power being utilized to compact the trash in the receptacle. This field intensity is sensed and amplified by the current sensor 100 and, in turn, measured and recorded by a microprocessor 112.

Since the current flow in conductor 75 is the same at any point on the line, current sensor 100 may be installed at any point between the power source (typically a utility powered outlet) and the compactor. Thus, the present invention provides installation flexibility. The sensor 100 is typically relatively small, and can be sized in the range of 2"×2"×¾". The current sensor 100 is installed by disconnecting the conductor 75, then slipping this conductor 75 through the opening in the donut-shaped portion 102 of the sensor 100, and then reconnecting this conductor. Electrical current used by a compactor hydraulic pump motor will vary. The sensor 100 may be selected in accordance with such variance so as to insure that reliable results are being obtained. Sensors 100 may be provided in multiple ranges. A sensor with a range of 0 to 75 amps is adequate for the majority of compactors.

Referring again to FIG. 2, the current sensor signal may be automatically conditioned to values appropriate for input for the microprocessor 112. Auto-zero and auto-ranging features are used in many devices, including multimeters. An example of multimeter auto-ranging is when the multimeter is in the mode of voltage measurements. Input amplifiers automatically detect the incoming voltage to be measured and automatically set the instrument's voltage range. The microprocessor 112 incorporates similar auto-ranging in its signal conditioning amplifier. The microprocessor 112 analyzes the background signal noise levels and the signal itself to determine when the compacting cycle begins, at which time the amplifier gain adjustments are automatically adjusted for maximum sensitivity and data resolution. During times of compactor inactivity, the microprocessor 112 auto-zero features automatically null out any effects of amplifier and/or sensor drift due to temperature or other changes.

It will be appreciated that reading the output of current sensor 100 over time will provide information from which a detailed record of the compaction cycle can be made or charted. This reading may be provided in volts. An example graph is provided at FIG. 3. The graph of FIG. 3 displays time on the horizontal or "x-axis" and volts on the vertical or "y-axis." A line 205 is generated that reflects the output of sensor 100. From 0 to 2 seconds the motor turn on transient occurs before any compacting action takes place. From 2 to 25 seconds, a steady motor current is observed during the forward motion before any compaction begins. Compaction build-up occurs during the 25 to 40 second interval, at which the peak voltage reading is observed. The peak reading in this example is in excess of 1.2 volts. During the 40 to 62 second interval, the compaction ram has reversed direction. At the 62 seconds mark, the motor powers down and the voltage reading falls to zero.

Figure 4:
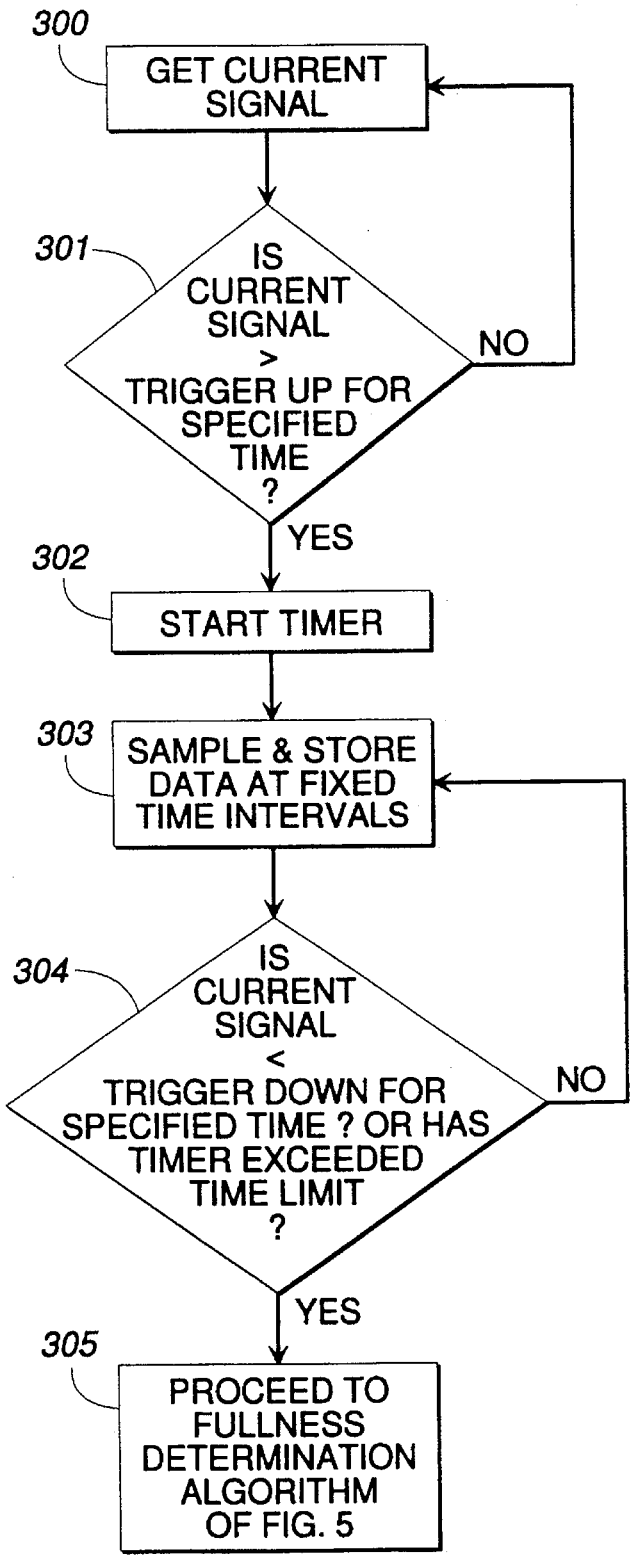
FIG. 4 shows a flow diagram representing an algorithm for collecting compaction cycle data.

FIG. 4 shows a flow diagram representing an algorithm for collecting compaction cycle data. Prior to the initiation of a compaction cycle, the compactor motor is de-energized, and thus the current sensor signal is zero for all practical purposes although there may be some slight offset plus noise background signal. The remote microprocessor 112 monitors the information received from the current sensor as indicated in step 300. The current sensor signal is evaluated at step 301 to determine if the signal increases above background and noise levels to a value higher than a preset threshold, called trigger-up, for a specified period of time (e.g. two seconds). If not, steps 300 and 301 are repeated. If so, the algorithm assumes flat a cycle has been initiated, starts a timer at zero seconds in step 302, and then proceeds to step 303. At step 303, the current sensor signal is periodically sampled and stored at fixed time intervals. In the preferred embodiment, the data sampling time period is 0.2 seconds. This value is not critical but the data sampling time period for any process should be fast enough not to compromise accuracy, but not so fast as to collect needless data. The current sensor signal is evaluated in step 304 to determine if the current signal has decreased below a trigger down level for a specified time (e.g. two seconds) or to determine if the timer has exceeded a time limit (e.g. three minutes). The trigger down level is the same value as the trigger up level. Because trigger up and trigger down are values above the background noise levels of particular compactor types, the values may vary from compactor to compactor. DIP switches on the remote computer monitor board may be used to adjust for the varying noise levels on particular compactors. In the preferred embodiment, the trigger up and trigger down levels are set approximately at 100 mV. If the current sensor signal has not decreased below the trigger down level, steps 303 and 304 are repeated. If so, at step 305 the set of current sensor signals taken during the compaction cycle are processed by the fullness reading extraction algorithm (FIG. 5) to extract a signal reading that is indicative of the maximum current sensor signal during compaction. This signal is stored in the memory bank that contains the last 199 cycle fullness readings, thus maintaining the last 200 cycle fullness readings. The numbers 199 and 200 are exemplary and are not critical.

Figure 5:
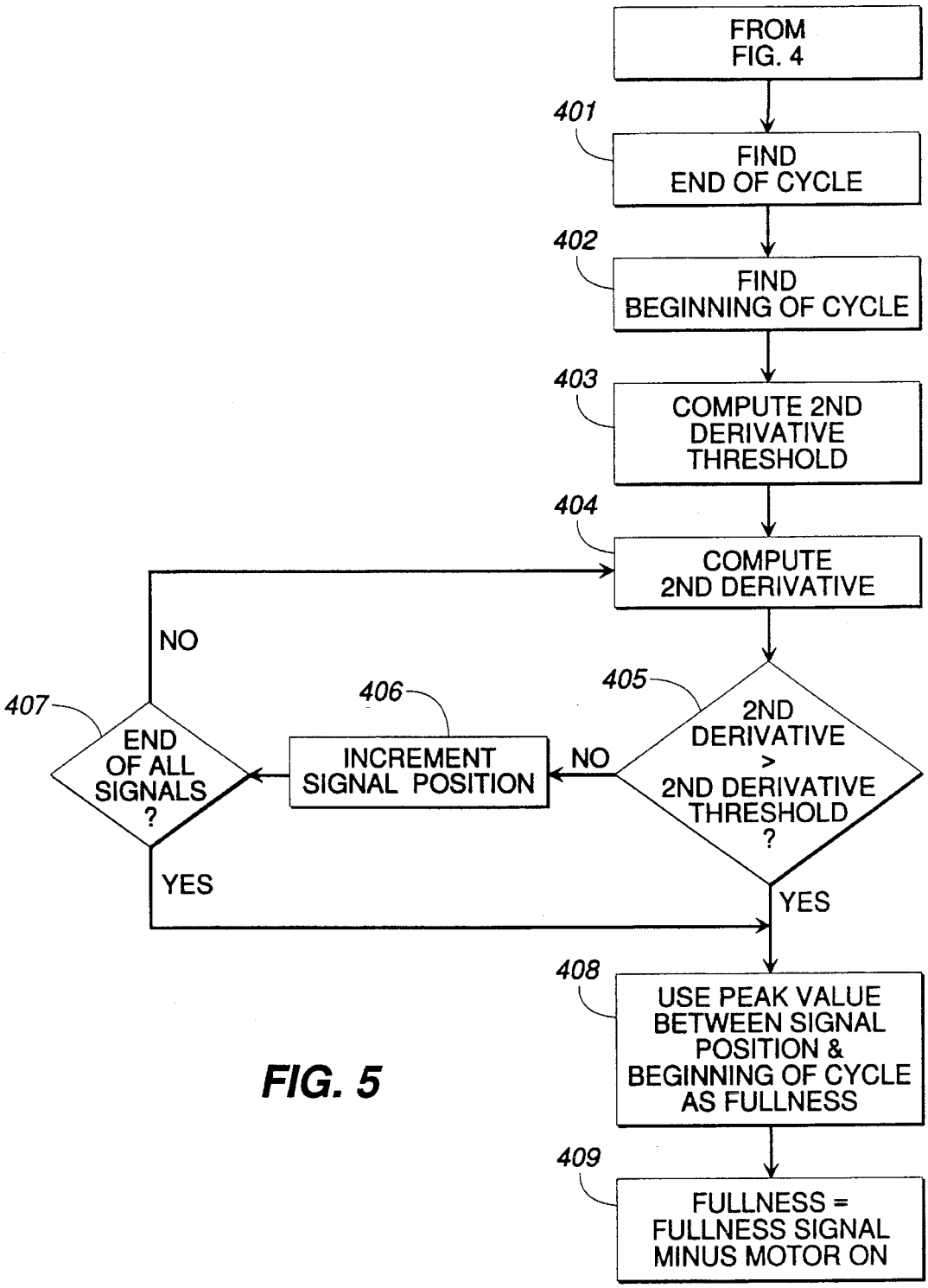
FIG. 5 shows a flow diagram for the fullness reading extraction algorithm.

FIG. 5 shows a flow diagram for the fullness reading extraction algorithm. The end of the compaction cycle is found at step 401. The end of the compaction cycle is either the current sensor signal that is less than some low percentage, for example 50%, of the motor-on signal, or the end of all cycle data at trigger down time, which ever occurs first. The beginning of the cycle is located from the data at step 402. The beginning of the cycle is the minimum signal obtained after the position indicating the initial two seconds of the cycle data and the end of the compaction phase of the cycle. The minimum signal obtained after the position indicating the initial two seconds of the cycle data is termed the motor-on signal.

The first derivative of a time varying signal defines the slope of the curve at the point the derivative is taken. For the current signal profile, the first derivative is defined as the magnitude of the difference between two consecutive current sensor signals divided by the sample time. The second derivative of a time varying function is defined as the magnitude of the difference between two consecutive first derivatives divided by the sample time. These derivatives, as well as other signals, readings and/or calculations, may be averaged, if desired, to reduce the effects of short term signal variations. A second derivative threshold is determined at step 403. The initial second derivative threshold is the peak signal minus the minimum signal between the beginning and end of the cycle data divided by the sample period 0.2. If the initial second derivative threshold is below a fixed minimum then the second derivative threshold is set to equal the fixed minimum. If the initial second derivative threshold is above a fixed maximum then the second derivative threshold is set to equal the fixed maximum. If the initial second derivative threshold is a value between the fixed minimum and fixed maximum, the second derivative threshold is set to equal the initial second derivative threshold.

The fixed minimum value is slightly above the derivative value of current sensor signal excursions due to background noise and signal variations during forward compaction ram motion while not compacting. The fixed maximum value is a value large enough to indicate a change in compactor ram motion from the forward to reverse direction.

In the preferred embodiment the fixed minimum value is 0.24 and the fixed maximum is 0.48. Other values may be used but experimental testing over a wide range of compactor types indicated that these values yielded the best results for the tested compactor types.

At step, 404, a second derivative is calculated. The second derivative is calculated from two modified first derivatives. The second derivative is the absolute value of the difference of the modified first derivatives divided by the sample time period 0.2 seconds. Each modified first derivative is the average of the absolute values of two consecutive first derivatives. Absolute values are used because signals at compaction ram reversal time sometimes have positive signal transitions, and sometimes negative signal transitions, and sometimes both. Averaging over a short span of cycle signals allows compaction ram reversal signal transitions to be additive and thus more detectable.

At step 405 if the second derivative is greater than the second derivative threshold then at step 408 the peak value between the beginning of cycle signal position and the present signal position is used as the fullness signal. The fullness signal is then set at step 409 to equal the fullness signal minus the motor-on signal. At step 405 if the second derivative is not greater than the second derivative threshold then at step 406 the signal position is incremented. The signal position is then evaluated to determine if the end of all current signals has been reached at step 407. If the end of all signals has not been reached then the next signal is processed at step 404. However, at step 407 if the end of all signals has been reached, indicating that a second derivative was not found greater than the second derivative threshold, then, at step 408, the peak reading between the signal position and the beginning of cycle position is used as the fullness reading. The fullness signal is then set at step 409 to equal the fullness signal minus the motor-on signal.

By determining the fullness reading from the entire stored compaction data set for a compaction cycle, the present invention is self calibrating in this regard, and does not have to have stored calibration constants to determine a forward peak reading.

The fullness of some types of compactors may be determined visually by observing the output waveform (FIG. 3) at the remote monitoring computer 122. By observing the waveform, an operator may compare, for accuracy, the signal which experience has indicated to be the accurate fullness reading for a particular compactor to the fullness reading selected according to the fullness reading extraction algorithm. An operator may input to a keyboard connected to the remote monitoring computer 122 the correct fullness reading or may use a conventional hand guided computer mouse to select and thus store the fullness reading from the display screen of the remote monitoring computer 122. Visually determining the fullness reading from the current sensor output waveform may either serve as a substitute for the fullness reading extraction algorithm (FIG. 5), or may be used as the primary means for determining the fullness of a trash receptacle for output waveforms which may vary from the waveforms for which the fullness reading extraction algorithm (FIG. 5) was designed or waveforms which may vary from normal waveforms due to abnormal operation of a compactor.

It is desirable to use a current sensor without the need for adding or using a second sensor and/or reversal signaling device. If an on/off reversal signal were used in addition to the current sensor signal, this additional on/off signal would serve as the correct position (or correct time) to sample the current sensor signal, thus reducing the amount of analysis required on the cycle waveforms. Through use of a reversal-signaling device, the current sensor algorithm is simplified to read the peak current sensor signal prior to compaction ram motion reversal from forward to reverse, thus recording the fullness reading at or before the fully extended position of the compaction ram. However, using a single current sensor provides certain advantages. One advantage is that the current sensor can be remotely located from the compactor without the additional costs of installing a reversal-signaling device. However, the current sensor can still be remotely located by installing a transmitting device at the compactor that superimposes a reversal signal on the power wires, and detecting this signal by a receiver at the current sensor location on the power wires. This is well known technology currently in use in homes for remotely turning on and off lights and other devices via similar transmitters and receivers connected to the power wires. Whether or not the reversal signal is local or remote, trash compactor monitors can utilize current sensors with the additional reversal-signaling device. Although it is desirable to use only a current sensor, it is not beyond the scope of this invention to use a reversal-signaling device.

Figure 3:
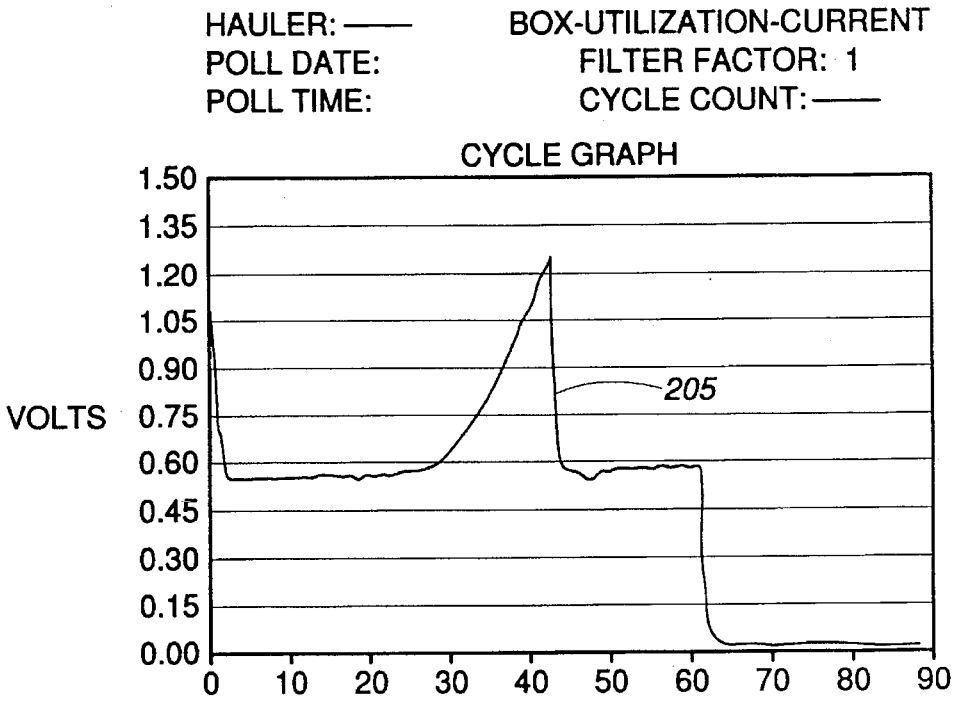
FIG. 3 is an example graph showing the voltage output of a current sensor in accordance with the present invention.

FIG. 3 showed an exemplary cycle profile. However, various compactors exhibit different cycle profiles which vary with the fullness of a receptacle. FIGS. 6A, 6B, 6C and 6D show exemplary cycle profiles of a compactor type A. FIGS. 7A, 7B, 7C and 7D show exemplary cycle profiles of a compactor type B. FIGS. 8A, 8B, 8C and 8D show exemplary cycle profiles of a compactor type C. As can be seen from FIGS. 7A, 7B, 7C, 8A, 8B and 8C the current reading during compaction ram reversal may exceed the forward current reading. When the current reading during compaction ram reversal is higher than the current reading during forward compaction ram motion, a system which determines fullness based on peak current reading for the entire cycle will yield erroneous fullness determinations.

As discussed above, in some compactors, the lower efficiency of movement in the reverse compaction ram motion causes higher current draw in the reverse compaction ram motion than in the forward compaction ram motion. The peak current reading in the forward compaction ram motion provides the most accurate indication of fullness of the compactor. A compactor system utilizing a current sensor to measure the compactor fullness must distinguish the current readings due to forward compaction ram motion from current readings due to reverse compaction ram motion in order to provide accurate fullness data. The present invention provides accurate compactor fullness determinations based on current readings for only forward compaction ram motion. It is be understood that the compaction ram may be referred to as a compaction arm of a compacting arm.

Figure 6A:
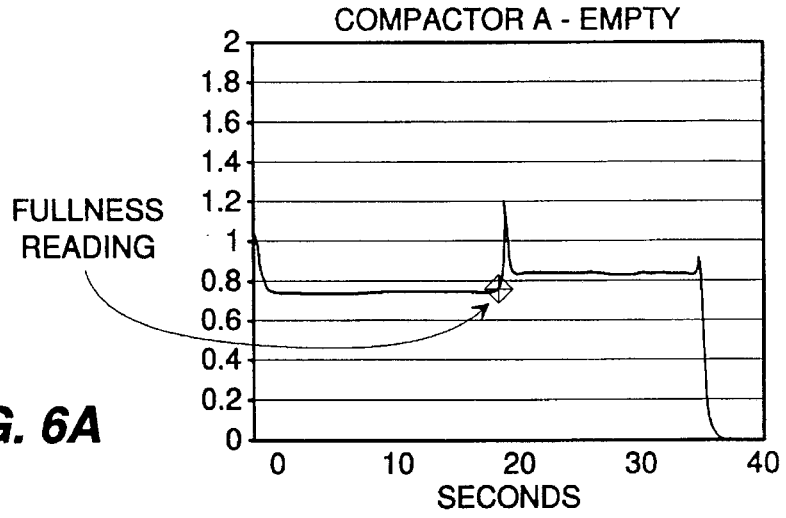
FIG. 6A is an example graph showing the voltage output for the current sensor from an empty compactor type A.
Figure 6B:
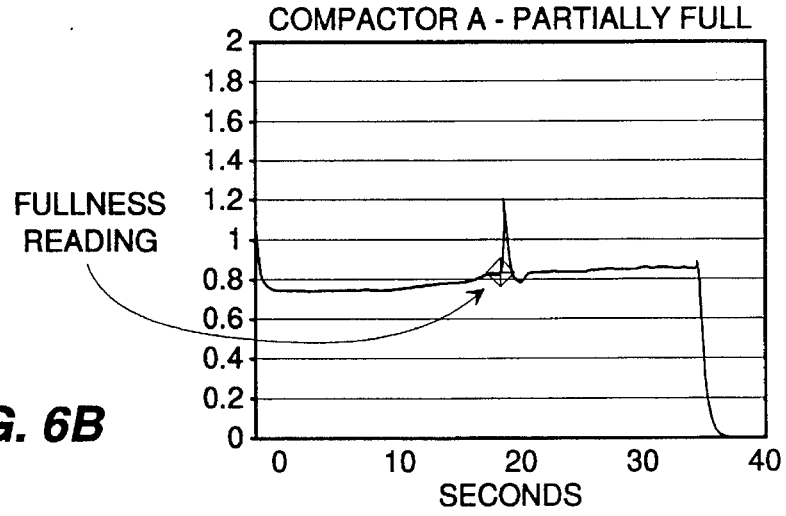
FIG. 6B is an example graph showing the voltage output for the current sensor from a partially full compactor type A.
Figure 6C:
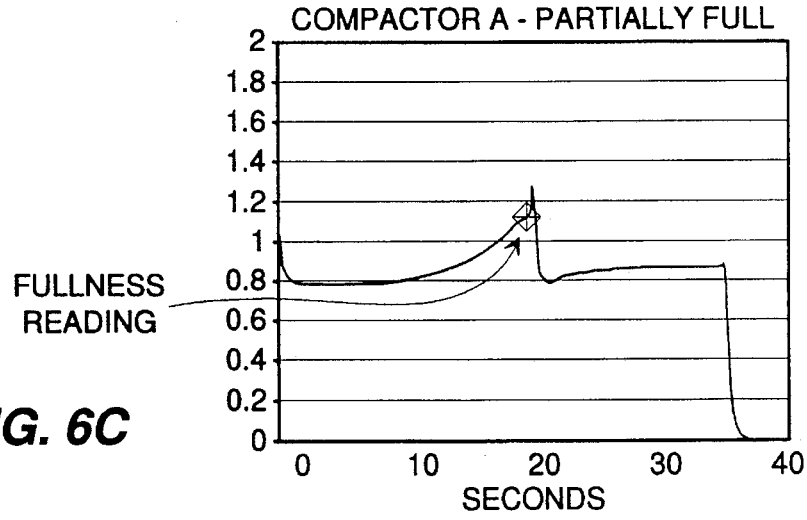
FIG. 6C is an example graph showing the voltage output for the current sensor from a partially full compactor type A.
Figure 6D:
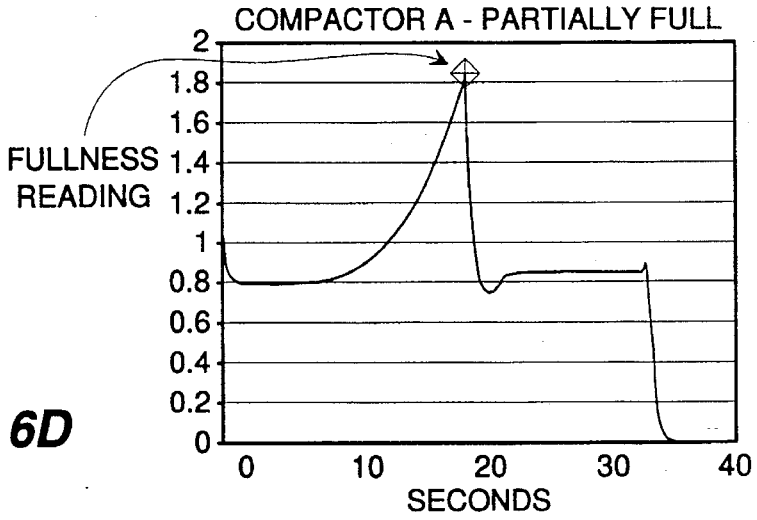
FIG. 6D is an example graph showing the voltage output for the current sensor from a full compactor type A.

Referring to FIG. 6A, the current spike shown results in a large value of the derivative. The current sensor signal selected by the fullness selection extraction algorithm is shown and is approximately the same value as the forward current. An algorithm designed to select peak readings would be considerably in error here. In an alternative embodiment, an algorithm with an averaging (filter) factor could be used to reduce the effect of the spike when making the fullness determination. FIG.. 6B shows a compactor type A which is partially full. The fullness reading for the forward compaction ram motion is approximately equal to the reverse current. In FIG. 6C, the forward current has exceeded the reverse current as the receptacle continues to fill. In FIG. 6D, when the compactor is full, the fullness reading is shown.

Figure 7A:
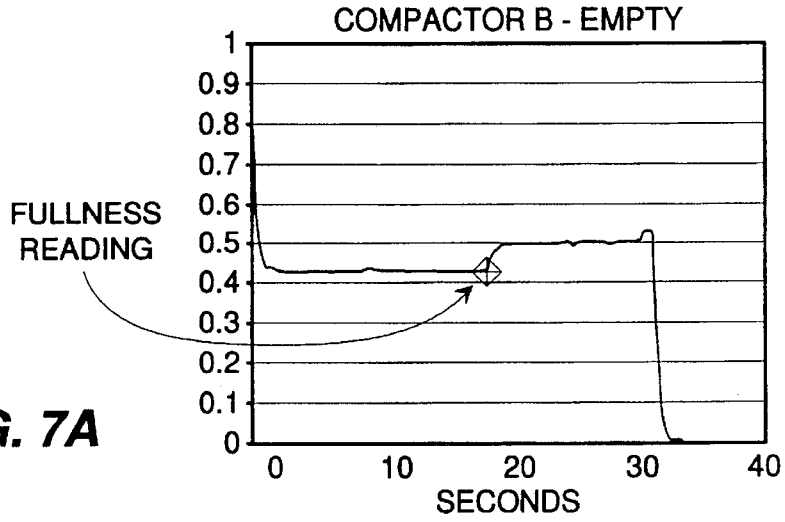
FIG. 7A is an example graph showing the voltage output for the current sensor from an empty compactor type B.
Figure 7B:
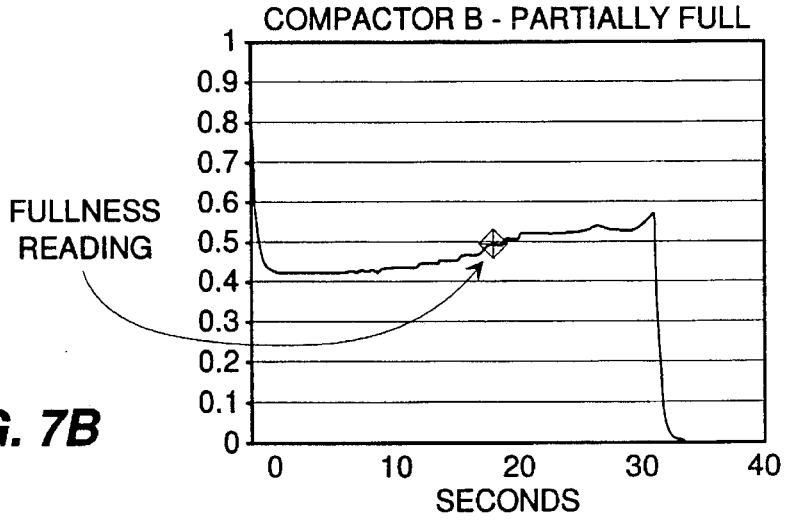
FIG. 7B is an example graph showing the voltage output for the current sensor from a partially full compactor type B.
Figure 7C:
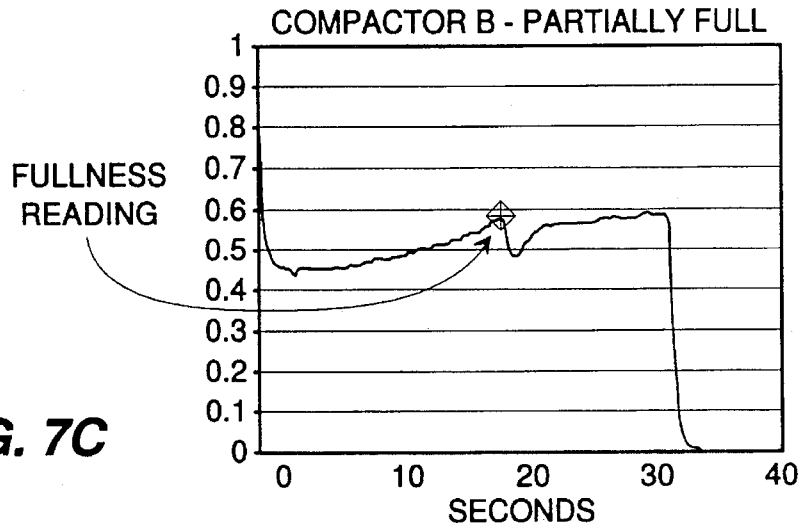
FIG. 7C is an example graph showing the voltage output for the current sensor from a partially full compactor type B.
Figure 7D:
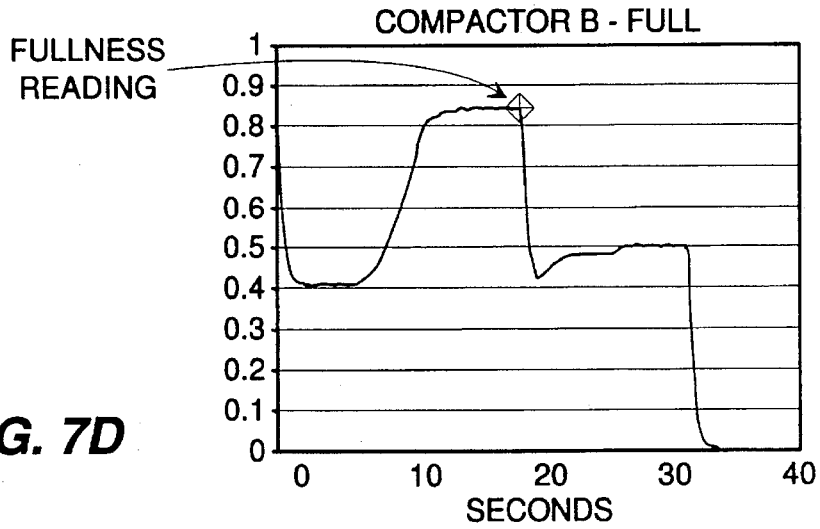
FIG. 7D is an example graph showing the voltage output for the current sensor from a full compactor type B.

In FIG. 7A, the empty compactor of type B has a small difference between the forward and reverse currents, thus a small value for the derivative at reversal time. The algorithm sets the second derivative threshold based on this difference, and thus is able to detect a small second derivative when inspecting the current sensor signals for the correct fullness reading. In FIG. 7B, the partially full compactor type B shows a forward fullness buildup current that is almost the same as reverse current. A second derivative is undetectable due to the small change in signal at reversal time. The fullness sample value is thus deemed to be the default peak reading. In FIG. 7C, as the forward compaction current of the partially full compactor B increases slightly higher than the reverse current at the point when motion reverses, the signal transition is now adequate to allow a second derivative detection. At this level of fullness, the second derivative signal selection is approximately the same for an algorithm designed to select the peak reading for an entire cycle. This is true anytime the forward peak reading is greater than the reverse current. In FIG. 7D, the compactor B is full. The flattening of the signal is due to the fact that the maximum possible pressure is reached before the ram is fully extended in the forward position, and thus the maximum current supplied to the system also flattens. As also shown in FIG. 7C, the second derivative selection of a fullness reading is the same as the peak reading for the entire cycle.

Figure 8A:
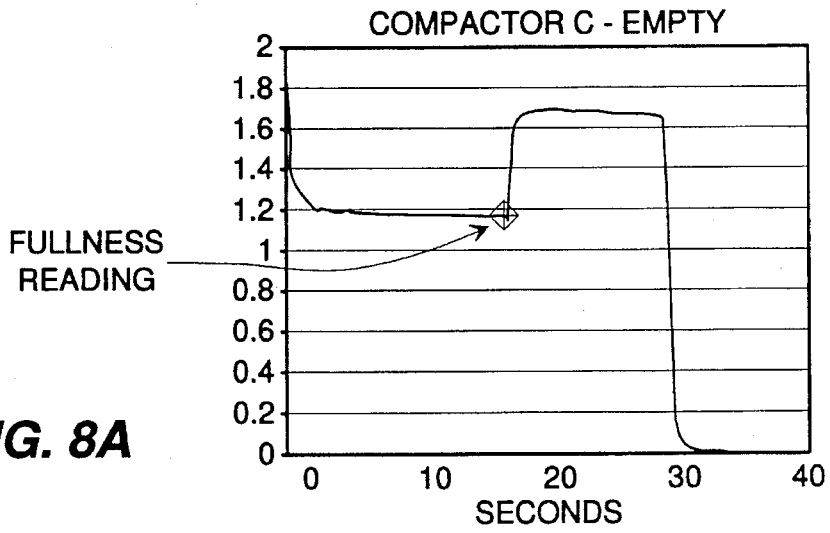
FIG. 8A is an example graph showing the voltage output for the current sensor from an empty compactor type C.
Figure 8B:
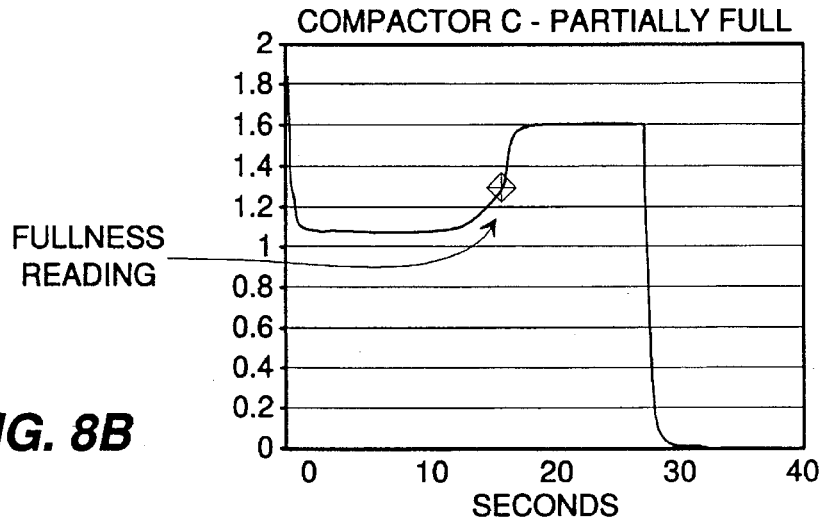
FIG. 8B is an example graph showing the voltage output for the current sensor from a partially full compactor type C.
Figure 8C:
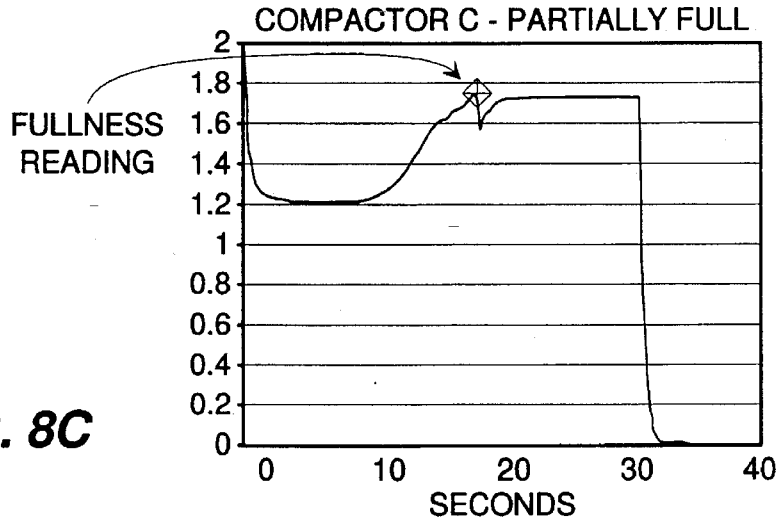
FIG. 8C is an example graph showing the voltage output for the current sensor from a partially full compactor type C.
Figure 8D:
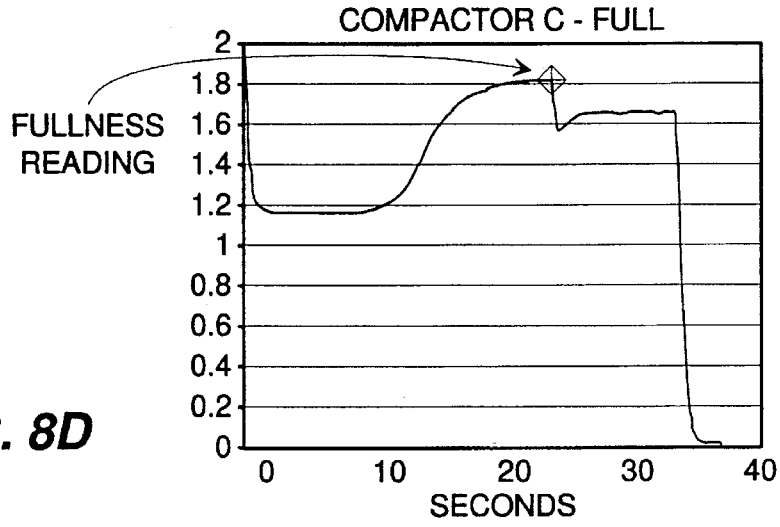
FIG. 8D is an example graph showing the voltage output for the current sensor from a full compactor type C.

In FIG. 8A, compactor C is empty. When compaction ram motion reverses from the forward direction to the reverse direction, the current sensor signal makes a step increase that results in a high value for the second derivative. The current sensor signal selected by the fullness selection extraction algorithm is shown and is approximately the same as the forward current. An algorithm designed to select the peak reading from the entire cycle would be in considerable error here. In FIG. 8B, a fullness reading was extracted at approximately the halfway point of the increasing slope of the graph. In FIG. 8C, although compactor C is almost full, the forward compaction ram current has just begun to reach the reverse current at the point when motion reverses. At this level of fullness, the second derivative is below the threshold, thus the peak reading is used as the fullness reading. In FIG. 8D, compactor C is full. The flattening of the signal is due to the fact that the maximum possible pressure from the hydraulic system is reached before the ram is fully extended in the forward position, and thus the maximum current supplied to the system also flattens. The second derivative has increased above the threshold level.

Figure 9:
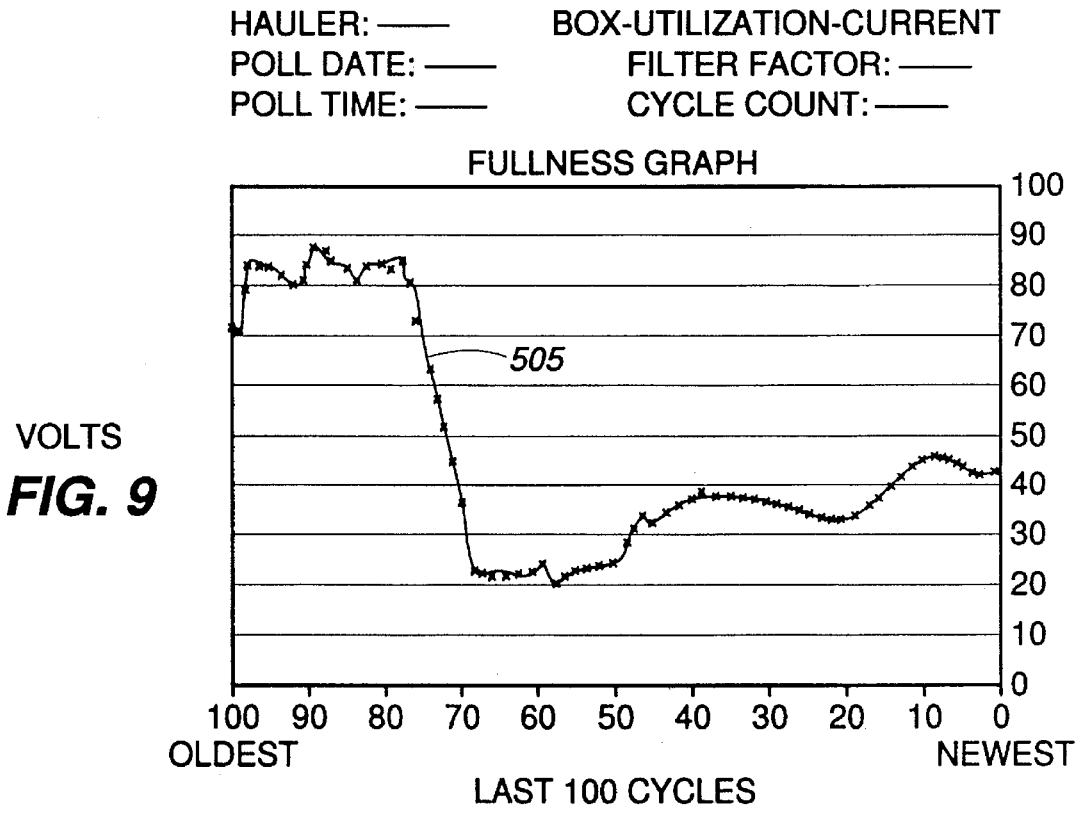
FIG. 9 is an example graph showing the peak readings obtained from a current sensor in accordance with the present invention over a series of compaction cycles.

Those skilled in the art will appreciate that the forward compaction ram peak readings may be monitored so as to detect the fullness of the container. The peak readings can then, in turn, be, graphed, such as indicated in step 411 of FIG. 4. An example of such a graph of peak readings is shown at FIG. 9. This graph shows the horizontal or "x-axis" displaying the last 100 compaction cycles and the level of fullness (in percent) on the vertical or "y-axis." It will be appreciated that the desired fullness percentage can be user defined, and in this example, it is shown as ninety percent (90%), thereby satisfying the tension between not prematurely emptying the receptacle and not allowing the receptacle to overflow. The compaction in this graph reached a desired maximum at compaction cycle 90, and remained at that level until compaction cycle 75. Those skilled in the art will appreciate that a certain number of compaction cycles must be performed in order to determine the value at which the receptacle should be emptied. False "full" readings can be filtered out in such a manner. The receptacle 15 was deemed full and emptied after compaction cycle 75. After that point, a line 505 shows a drop in the readings. The line 505 then begins a gradual upward trend reflecting use of the compactor.

All such information may be monitored at a remote site by means of a computer 122, as shown in FIGS. 1 and 2. Such information may be collected over the telephone lines through the use of modems and other known devices. The display of such information may be done on site at display 120 in conjunction with the microprocessor 112. Such a display is known and the details need not be disclosed further herein. Additionally, the information may be displayed on a remote computer that can track the status of a multiple number of compactors. Thus, a plurality of compactors and receptacles provided with the present invention may be monitored. In this manner, the use of a hauler and the emptying process may be done efficiently and accurately.

In view of the foregoing, it will be appreciated that the present invention accomplishes the objects set forth above and fulfills the previously described needs in the prior art. It will be further appreciated that many alternative embodiments of the present invention may be created and therefore the scope of the present invention is to be limited only by the claims set forth hereinbelow.

I claim:

1. An apparatus to monitor the amount of trash in a trash receptacle and compactor unit, said compactor unit having an electric motor for compacting trash within said trash receptacle, said electric motor drawing a first current when compacting said trash and a second current when repositioning after compacting said trash, said apparatus comprising:

means for measuring the current drawn by said electric motor during operation of said comparator unit; and means responsive to said current drawn by said electric motor during operation of said compactor unit for determining the amount of trash within said trash receptacle, wherein said responsive means determines a derivative of said current drawn and compares said derivative to a derivative threshold to determine said amount of trash.

2. The apparatus of claim 1 wherein said responsive means determines said derivative from the absolute value of two consecutive modified derivatives of said current drawn.

3. The apparatus of claim 2 wherein said responsive means determines each said modified derivative by averaging the absolute values of two consecutive first derivatives of said current drawn.

4. A trash compactor, comprising:

a trash receptacle;

a compactor unit having an electric motor for compacting trash within said trash receptacle, said electric motor drawing a first current when compacting said trash and a second current when repositioning after compacting said trash;

means for measuring the current drawn by said electric motor during operation of said compactor unit; and means responsive to said current during operation of said compactor unit for determining the amount of trash within said trash receptacle, wherein said responsive means determines a derivative of said current drawn and compares said derivative to a derivative threshold to determine said amount of trash.

5. The apparatus of claim 4 wherein said responsive means determines said derivative from the absolute value of two consecutive modified derivatives of said current signal.

6. The apparatus of claim 5 wherein said responsive means determines each said modified derivative by averaging the absolute values of two consecutive first derivatives of said current signal.

7. A method of monitoring the amount of trash in a trash receptacle and comparator unit, said comparator unit having an electrical motor, comprising the steps of:

measuring a first current drawn by said electric motor when compacting said trash and a second current when repositioning after compacting said trash; and determining said amount of trash in said trash receptacle by comparing a derivative of said current drawn to a derivative threshold.

8. The method of claim 7 wherein said derivative is determined from the absolute value of two consecutive modified derivatives of said current drawn.

9. The method of claim 8 wherein each modified derivative is determined by averaging the absolute values of two consecutive first derivatives of said current drawn.

* * * * *